United States Patent [19]

Brand

[11] 4,055,243

[45] Oct. 25, 1977

[54] COIN OPERATED TIMER

[76] Inventor: Glenn C. Brand, Star Rte., Box 28C, Marcell, Minn. 56657

[21] Appl. No.: 708,738

[22] Filed: July 26, 1976

[51] Int. Cl.[2] ..... G07F 5/04

[52] U.S. Cl. ..... 194/61

[58] Field of Search ..... 194/9 T, 61-65, 194/97, 66, 83-90

[56] References Cited

U.S. PATENT DOCUMENTS

| | | | |
|---|---|---|---|
| 1,945,343 | 1/1934 | Clayton et al. | 194/61 |
| 2,321,136 | 6/1943 | Grau | 194/61 |

*Primary Examiner*—Stanley H. Tollberg

[57] ABSTRACT

A coin responsive device actuates a motor driven time only if a pair of predetermined coins have been deposited. The device comprises a manually rotatable disk containing first and second circumferentially arranged coin receiving slots. The disk is secured to a central shaft, and a ring member having first and second detents is concentrically attached to the disk. A dog mounted adjacent the ring member is pivotable between first and second positions. The dog is spring-biased into the first position wherein the dog is engageable with either of the ring member detents for locking the disk against rotation. A friction clutch between the shaft and disk prevents damage by forcing rotation of the disk when it is locked. A cam member contacting the coins during rotation of the disks urges the dog into the second position wherein the dog is clear of the detents. As a result, the disk can be fully rotated only if both coins are in place within the receiving slots. During full rotation of the disk, a switch is tripped to complete an electrical circuit for energizing the timer. After a predetermined time period, a rotary actuator on the output shaft of the timer motor breaks the circuit.

18 Claims, 9 Drawing Figures

COIN OPERATED TIMER

BACKGROUND OF THE INVENTION

The present invention relates generally to coin operated apparatus, and more particularly, toward a highly reliable two-coin device for actuating a timer only if both coins have been properly deposited.

Coin-operated apparatus are presently used in self-service applications ranging from beverage dispensing to automated car washing. A coin is deposited into a receiving slot in a coin responsive device, and a shaft of the device is manually rotated to perform a designated function. As the shaft is rotated, the coin cams a lever arm or dog out of engagement with a locking member on the disk so that the disk can be fully rotated. At some angle of rotation of the disk, solenoids, timers, etc., are suitably actuated. If a coin is not properly deposited, on the other hand, the disk is locked against full rotation.

While generally somewhat satisfactory, prior coin actuated devices have been relatively complex and prone to breakage. For example, in order to defeat a typical coin actuated device, the central shaft attached to the coin-carrying disk is sometimes force-rotated using a wrench or other tool. As a result, the shaft itself is deformed and locking members within the device may be sheared. Various clutch arrangements have been provided to cause some slippage between the central shaft and disk to prevent damage by forced rotation, but, so far as I am aware, such clutches are complex and have proven to be unreliable.

Even more complex are multiple coin, coin-controlled switches that actuate a timer, solenoid, etc., in response to deposit of at least two predetermined coins. In the past, mechanisms for handling multiple coins have required a relatively large number of moving parts, and are particularly subject to breakage. Such mechanisms typically align the coins in contact with each other in a common slot of a rotatable disk. During rotation of the disk, the outermost coin contacts a dog-releasing cam. As contact is made, a lever arm or dog is pivoted out of locked engagement with the disk.

The coins tend to overlap one another causing jamming. Damage is sometimes caused by an attempt to force-rotate a jammed disk in order to free-up overlapped coins. The mechanism must be removed for service in order to free the coins, or for other maintenance. This usually requires cutting electrical wires and then splicing them during reinstallation. The result is reduced profits caused by tie-up of the coin operated apparatus and increased overhead.

OBJECTIVES OF THE INVENTION

Accordingly, one object of the present invention is to provide a new and improved coin actuated device.

Another object of the present invention is to provide a new and improved multiple coin actuated device that is not prone to jamming by overlapping coins.

Still another object of the present invention is to provide a new and improved coin operated rotary device that is impervious to damage by forced rotation.

Another object of the present invention is to provide a new and improved multiple coin actuated rotary device having a clutch mechanism for causing slippage between a central operating shaft and coin receiving disk to prevent damage by forced rotation.

Still another object of the present invention is to provide a new and improved multiple coin operated device that is rugged and contains a minimum number of moving parts.

Yet another object of the present invention is to provide a new and improved multiple coin actuated device, wherein a motor driven timer is energized if sufficient coinage is deposited, and then automatically de-energized after a predetermined period of time.

BRIEF DESCRIPTION OF THE INVENTION

A multiple coin responsive mechanism, in accordance with the invention, comprises a coin-carrying disk containing a pair of circumferentially spaced, coin receiving slots exposed through corresponding apertures in a cover plate. A ring member having an outer wall containing first and second detents is secured to the disk concentrically therewith. A manually rotatable shaft extends through the center of the disk as well as through the cover plate.

An actuator member is connected between the shaft and the ring, so that the disk and the shaft rotate together. Mounted to a frame adjacent the disk, a lever arm or dog is pivotable between first and second positions. In the first position, one end of the dog is engageable with either of the ring member detents to lock the disk against rotation. A spring is provided to bias the dog into the first position. The opposite end of the dog is secured to a cam pivotally mounted adjacent the periphery of the disk.

Coins in the receiving slots of the disk extend beyond the periphery of the disk. During rotation of the disk, the coins contact the cam urging the dog into the second position wherein the disk is released for full rotation.

The coin carrying disk is fully rotatable only if both coins are properly located in their respective slots. In the absence of a coin in the first coin receiving slot, the dog is biased into engagement with the first detent of the ring member during rotation of the disk. The disk is locked in place early in its rotation. On the other hand, if a coin is absent only from the second coin receiving slot, the dog is urged into engagement with the second detent. In either case, the detent is locked against full rotation. A pawl member mounted to the frame and biased against the ring member prevents back rotation of the disk.

In order to prevent damage to any of the parts of the mechanism by forcing rotation of the locked disk using a wrench or other tool, a friction clutch is provided between the central shaft and actuator member. The clutch comprises a nut threaded to the central shaft and locked in position in contact with a washer engaging the actuator, and a spring located on the shaft to bias the actuator member against the nut and washer. Mechanical coupling is effected by frictional resistance established between the nut and washer and actuator member. As the torque applied to the central shaft exceeds a predetermined, maximum amount, slippage between the central shaft and actuator member prevents damage to the mechanism by excessive torque.

The timer motor is energized and de-energized by a limit switch mounted to the frame adjacent the timer motor output shaft. A rotary actuator, connected to the shaft of the timer motor, contains a pair of diametrically opposed pins respectively on opposite faces of the actuator. When the rotary actuator is in a predetermined angular position, the first pin is oriented so as to maintain the switch open and timer motor de-energized. When the rotary actuator is rotated past the predetermined position, the switch is closed and timer motor energized. After one full revolution of the timer shaft, the first actuator pin reopens the limit switch, de-energizing the timer motor.

Rotation of the actuator on the timr motor beyond the predetermined position is caused by a distal portion of the actuator member that extends beyond the ring member on the coin-carrying disk. Upon full rotation of the disk (both coins properly in place), the actuator member rotates the rotary actuator just enough to trip the limit switch completing an electrical circuit and energizing the timer motor. The actuator member is angularly oriented on the disk such that the second coin drops from the slot into a receptacle just as the timer is energized. After the predetermined time period, the rotary actuator completes a full circle and the first pin reengages the limit switch to break the circuit.

The output of the timer is supplied to a control unit that operates a vehicle washing station or other timed load. The timer motor, limit switch and other electrical components such as on-off and wash/wax/rinse switches are connected to a control panel using snap-on electrical connectors. As a result, the entire unit can be easily connected and removed from the panel without any special tools.

Still other objects and advantages of the present invention will become apparent to those skilled in the art from the following detailed description wherein I have shown and described only a specific embodiment of the invention, simply by way of illustration of the best mode contemplated by me of carrying out my invention. As will be realized, the invention is capable of other and different embodiments, and its several details are capable of modifications in various respects, all without departing from the invention. Accordingly, the drawings and description are to be regarded as illustrative in nature and not as restrictive.

DETAILED DESCRIPTION OF A SPECIFIC EMBODIMENT

Figure 1:
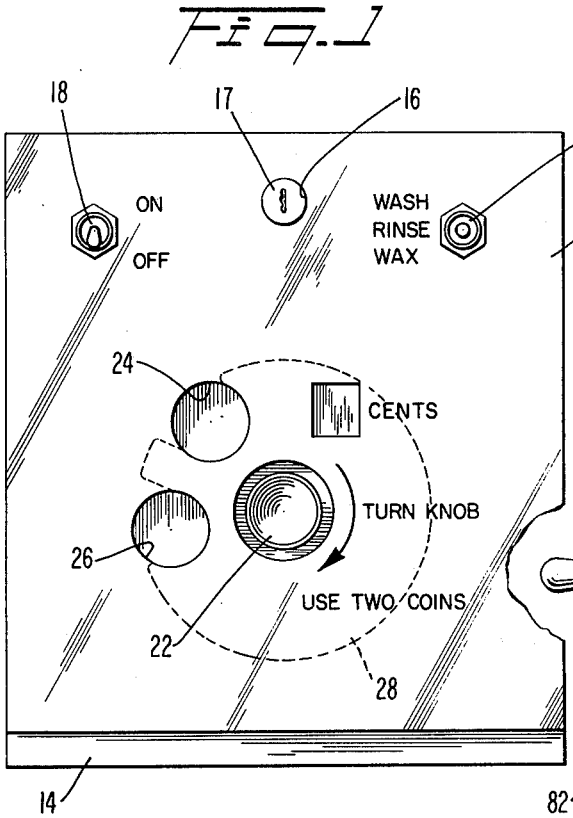
FIG. 1 is a front view of a cover plate and frame for supporting the coin-operated device of the present invention.
Figure 1A:
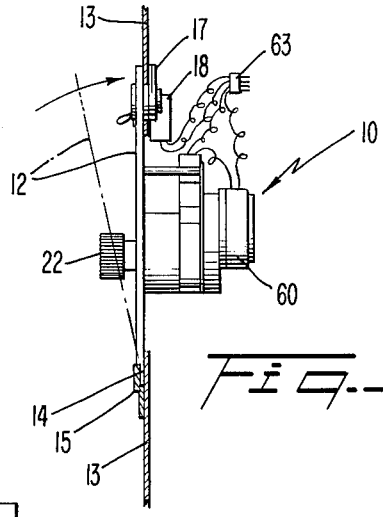
FIG. 1*a* is a side view illustrating installation of the device into a panel.

Referring to FIGS. 1 and 1*a*, a coin responsive device 10, in accordance with the present invention, is shown mounted to cover plate 12 adapted to be mounted into a panel 13 containing timer-controlled apparatus (not shown). The lower portion of cover plate 12 contains a recessed portion 14 adapted to mate with a corresponding lip 15 (FIG. 1*a*) on the panel 13, and an upper portion of the cover plate 12 contains aperture 16 for receiving a suitable key-operated latch 17. Cover plate 12 is secured to panel 13 by first fitting recessed portion 14 into the panel lip 15 and then swinging the upper portion of the cover plate against the panel, as shown, locking the panel in place with latch 17.

Figure 2A:
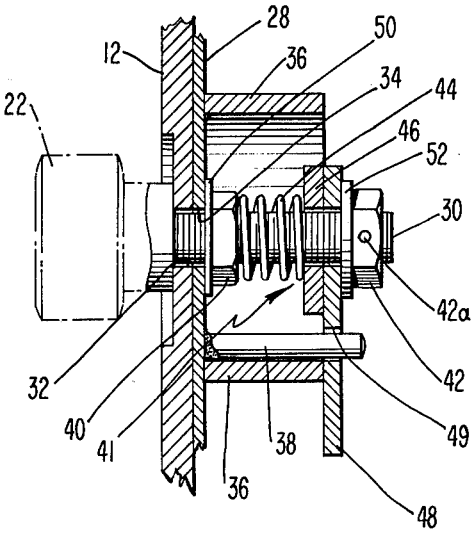
FIG. 2*a* is a detailed view of the friction clutch incorporated in the invention.
Figure 2:
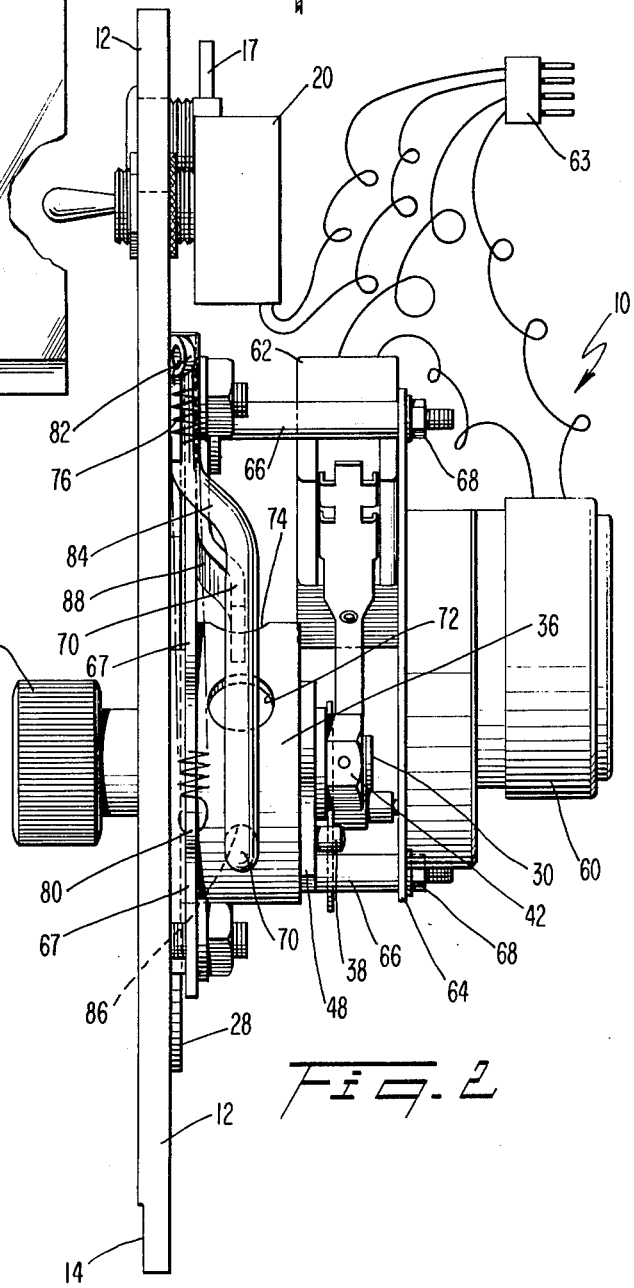
FIG. 2 is a side view of the device of FIG. 1 exposing the components thereof.

Referring to FIGS. 1*a* and 2, switch 20, switch 18 (shown in FIG. 3), timer motor 60 and switch 62 are electrically connected to a plug-in connector 63. During installation of cover plate 12 in panel 13, connector 63 is simply mated to a corresponding female connector in the panel whereby all electrical connections between the panel and cover plate elements are made without splicing.

In the specific embodiment, coin responsive device 10 is described with respect to the control of an automated, timer-controlled, vehicle washing unit. However, it is to be understood that the principles of the present invention can be applied to other control applications.

Mounted to and extending through cover plate 12 are on-off switch 18, wash/wax/rinse selector switch 20 and knob 22 of coin responsive device 10. A pair of apertures 24 and 26 are formed in the cover plate 12 to receive coinage. In response to a pair of suitable coins deposited in apertures 24 and 26, timer motor 60 is energizable for a predetermined time duration as will become clear from the following. Furthermore, a selection of washing mode is controlled by cover plate switch 20.

Referring to FIG. 2, coin responsive device 10 includes a coin-carrying disk 28 (see also FIG. 2*a*) in abutment to the inner surface of cover plate 12. A central threaded shaft 30 extends through aperture 32 in cover plate 12 as well as through aperture 34 in disk 28, thereby the disk is rotatably journaled about the central shaft 30. A ring member 36 is secured to disk 28 and is concentric to shaft 30. An arm 38 welded to disk 29 and also to the inner wall of ring member 36 extends beyond the ring and is linked to a central portion of an actuator member 48. One end of actuator member 48 is coupled to shaft 30 and the opposite end is free.

Referring to FIG. 2*a*, nuts 40 and 42 are threaded respectively on the center portion and an end of shaft 30. Nut 42 is locked against rotary movement by a stake pin 42*a*. Between the nuts 40 and 42, there are located spring 44, washer 46 and actuator member 48. A washer 50 is positioned between nut 40 and the face of disk 28. Similarly, washer 52 is positioned between nut 42 and against actuator member 48. Nut 42 is tightened down on threaded shaft 30 against the force of spring 44, sandwiching actuator member 48 between washer 46 and washer 52. Frictional resistance is established between the washers 46 and 52 and actuator member 48. Washers 46 and 52, spring 44 and actuator member 48 constitute a friction clutch 41 whereby the actuator member 48 is rotated about central shaft 30 as the shaft is manually rotated at knob 22. Disk 28 is similarly rotated by actuator member 48 due to linkage between the actuator member and arm 38.

The purpose of friction clutch 41 is to prevent damage to shaft 30 and other elements when, to force rotation of the disk 28 without depositing the proper coinage, excessive torque is applied to the shaft. When the torque applied to shaft 30 exceeds a maximum value, determined by the surface contact area of washers 46, 52 and the force of spring 44, there is slippage of the shaft relative to actuator member 48.

Of particular importance, spring 44 maintains washer 46 in firm contact with actuator member 48 so that there is no slippage unless the maximum torque is exceeded. There is, accordingly, no "wearing away" of the clutch surface tending to reduce frictional resistance as in prior art coin responsive device clutches of which I am aware.

Actuator member 48, located between washer 46 and nut 42, is linked to arm 38 through aperture 49 formed in the member 48. In addition to functioning as a linkage between actuator member 48 and ring member 36, arm 38 also stabilizes actuator member 48 by providing a second support point for the member, as best shown in FIG. 2*a*.

Timer motor 60 and limit switch 62 are mounted on opposite faces of plate 64 (FIG. 2). The plate 64 in turn is mounted on pedestals 66 and secured thereto with nuts 68 to maintain the motor 60 and switch 62 spaced away from cover plate 12.

Figure 3:
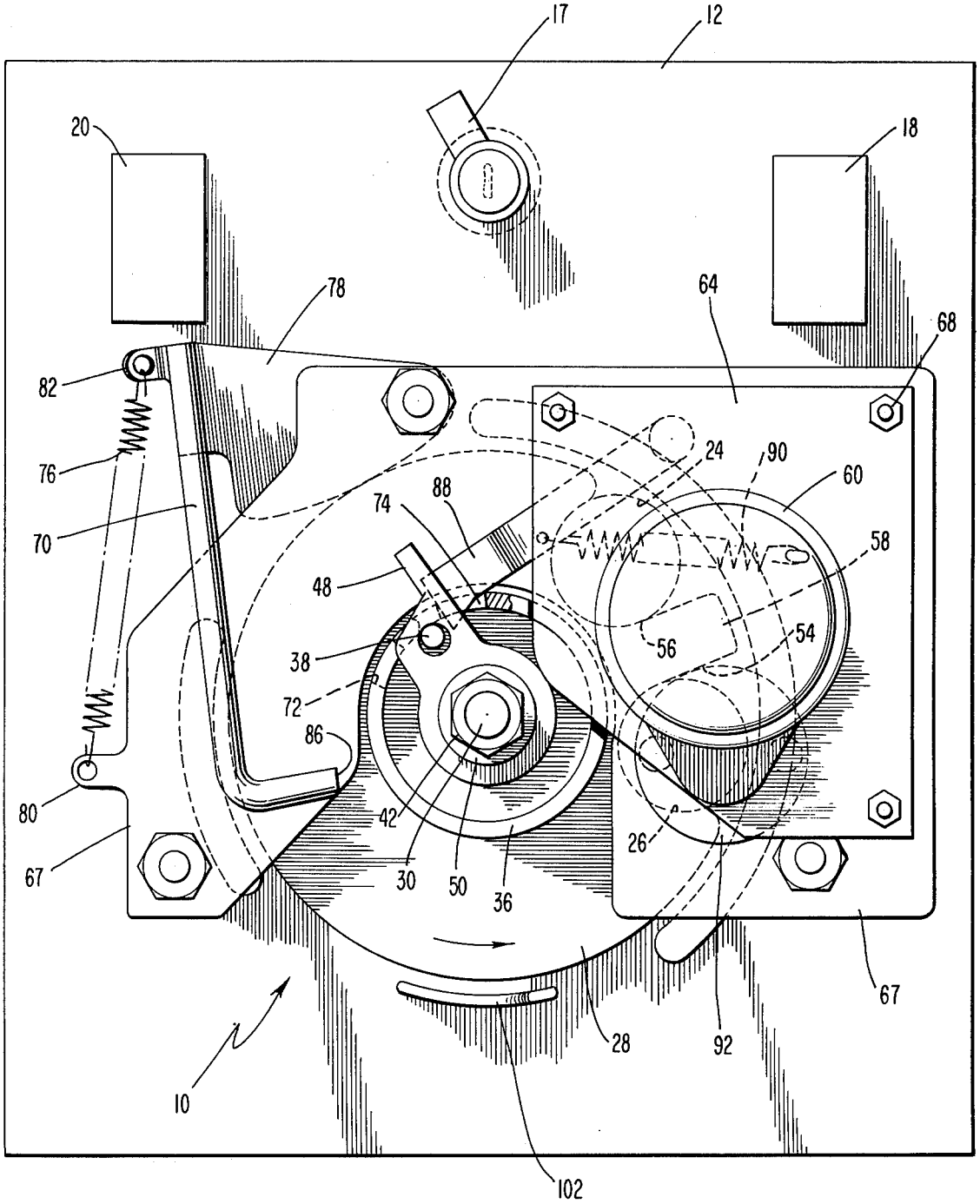
FIG. 3 is a rear view of the device of FIG. 1 showing the primary components thereof in the "home" position.

Referring now to FIG. 3, coin-carrying disk 28 contains a pair of circumferential coin receiving slots 54 and 56, spaced apart from each other for alignment with apertures 24 and 26 (FIG. 1). The slots 54 and 56 are separated from each other by a radial member 58. Radial member 58 prevents coins deposited in slots 54 and 56 from contacting each other and possibly overlapping to jam the disk 28 and prevent rotation thereof.

Mounted to cover plate 12 is a lever arm or dog 70 pivotable between a first position (FIG. 4) wherein the dog is pivoted toward ring member 36 on disk 28 and a second position (FIG. 3). The ring member 36 contains first and second apertures or detents 72 and 74 located in line to each other and circumferentially spaced apart along the ring member wall (see FIG. 2).

In the first position, dog 70 is engageable with either the first detent 72 or second detent 74 of ring member 36. It is apparent that with dog 70 engaged with either detent 72 or 74, disk 28 is locked against either clockwise or counterclockwise rotation. In the second position, dog 70 is free of the detents 72 and 74, releasing disk 28.

Figure 4:
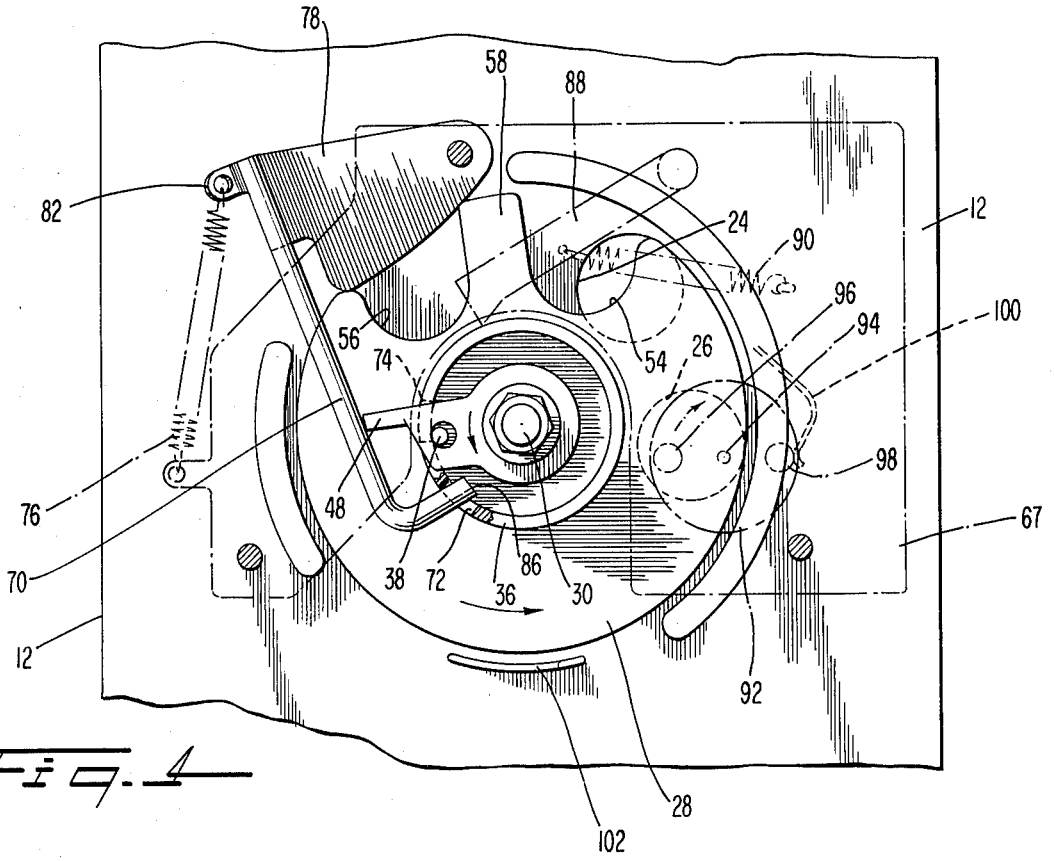
FIG. 4 is a rear view showing the device with no coins deposited, and the dog engaged with the first detent of the ring member.

A pawl member 88 is also mounted to frame plate 67 adjacent ring member 36. The pawl 88 is located in alignment with detents 72 and 74 in ring member 36 (FIG. 2) and is biased against ring member 36 by spring 90. The pawl 88 engages with detents 72 and 74 during rotation of the disk (see arrow) as shown in FIG. 4; the pawl 88, engaging the detents, jams the disk against clockwise (reverse) rotation.

Referring to FIG. 2, portion 84 of dog 70 is angled outwardly from cover plate 12 to provide clearance with respect to frame plate 67. End 86 of dog 70 extends parallel to cover plate 12 in alignment to detents 72 and 74 in ring member 36.

A cam 78 (FIG. 3), pivotally mounted between cover plate 12 and frame plate 67 is secured to one end of dog 70. Dog 70 is thus pivotal between the first and second positions by cam 78. A spring 76 is coupled between tab 80 on frame plate 67 and tab 82 to bias dog 70 toward the first position.

Cam 78, slidably retained between cover plate 12 and frame plate 67, is urged into contact with the periphery of disk 28 by spring 76, maintaining the dog 70 in the second position (FIG. 3). During counterclockwise rotation of the disk 28 from the "home" position shown in FIG. 3 (see arrow), slots 54 and 56 swing around toward cam 78. If there is a coin in slot 56 (FIG. 3), as the slot is drawn along the surface of the cam, the coin within that slot retains dog 70 in the second position out of engagement with detents 72, 74. On the other hand, if there is no coin in slot 56 (see FIG. 4), cam 78 is pivoted by the force of spring 76 into the mouth of the slot toward the first position causing end 86 of dog 70 to become engaged with the first detent 72 in ring member 36. Engagement between dog 70 and ring member 36 prevents further rotation of disk 28.

Figure 5:
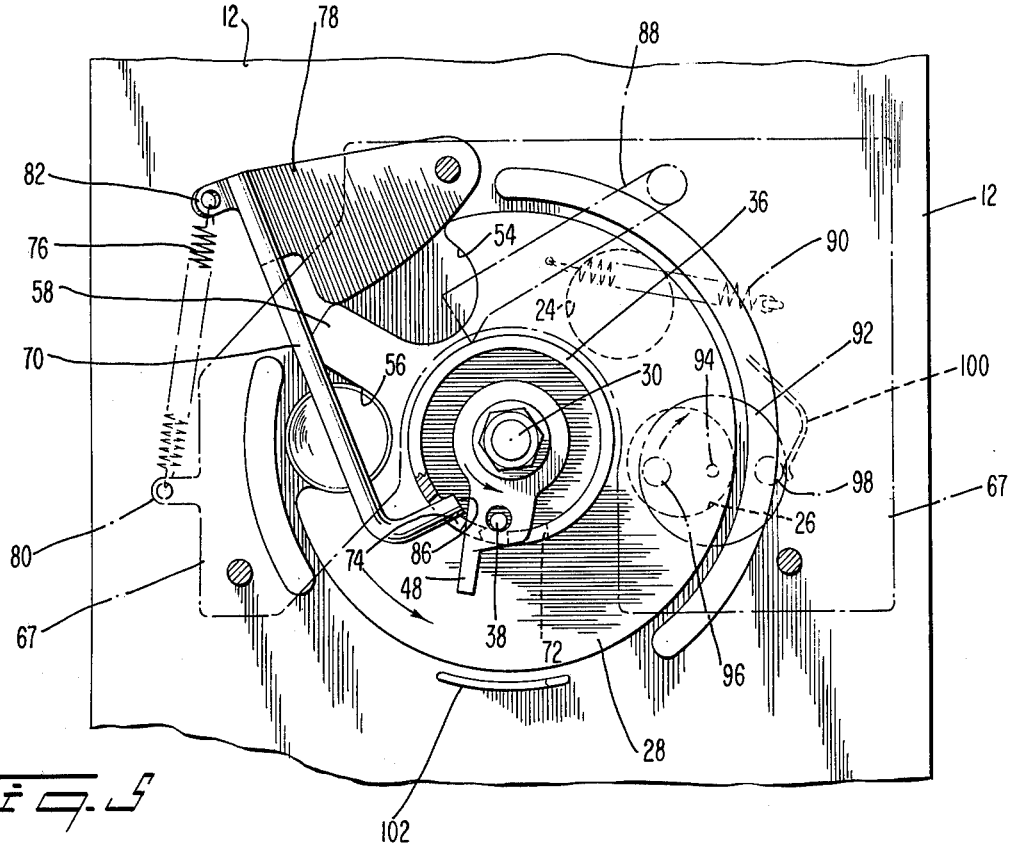
FIG. 5 is a rear view showing the device with only the first coin deposited and the dog engaged with the second detent of the ring member.

Assume that there is a coin in slot 56 but no coin in slot 54, as shown in FIG. 5. As disk 28 is further rotated so as to bring slot 54 adjacent cam 78, the dog 70, biased toward the mouth of the slot, is pivoted to the first position. End 86 of dog 70 thus becomes engaged with detent 75, and disk 28 is locked in place against further rotation.

It is apparent that full rotation of disk 28 is possible only if coins are suitably deposited in both coin receiving slots 54 and 56 of disk 28. If a coin that is smaller than the predetermined coin is deposited into either of the coin receiving slots 54 or 56, for example, a dime rather than a quarter, the diameter of the coin will be insufficient to urge the dog out of the first position, and the disk 28 will remain locked.

A rotary actuator 92 is attached to output shaft 94 of timer motor 60, as shown in FIGS. 3–7. The rotary actuator 92 contains a pair of diametrically opposed pins 96 and 98 located respectively on opposite faces of the rotary actuator. Pin 96 extends toward cover plate 12 and is located so as to be contacted by actuator member 48 during rotation of shaft 30. Pin 98 on the opposite face of the rotary actuator 92 is positioned so as to contact switch actuator 100 of limit switch 62 (see also FIG. 2).

Timer motor 60 is energized by a source of electrical current (not shown) connected in series to the motor and to a pair of contacts (not shown) in switch 62. When switch actuator arm 100 is in the engaged position shown in FIGS. 4 and 5, the switch contacts are open and timer motor 60 is de-energized. On the other hand, when actuator arm 100 is in the non-engaged position shown in FIG. 7, the contacts of switch 62 are closed and timer motor 60 is energized. Rotary actuator 92 rotates only when timer motor 60 is energized.

In operation, with disk 28 and rotary actuator 92 in "home" position, shown in FIG. 3, a pair of coins are deposited into coin receiving slots from apertures 24 and 26 at the front of cover plate 12 (see FIG. 1). By gripping knob 22 and rotating it clockwise from the front of the cover plate 12 as shown, disk 28 (viewed from behind the cover plate as in FIGS. 3–7) is rotated counterclockwise until the first slot 56 is brought into position adjacent cam 78. If there is a coin in slot 56, the cam 78 rides the rim of the coin, retaining dog 70 in the second position out of engagement with detent 72 on ring member 36. On the other hand, if there is no coin in slot 56, as shown in FIG. 4, the dog 70 is pivoted into the first position in engagement with detent 72. Disk 28 is thus locked against further rotation.

Assuming that there is a coin in only slot 56, as shown in FIG. 5, the disk 28 is further rotated until slot 56 is moved into place adjacent cam 78. Dog 70 is retained in the second position out of engagement with detent 74 in ring member 36. However, since there is no coin deposited in slot 54, the dog 70 is pivoted into the first position in engagement with detent 74 locking the disk 28 against further rotation.

Figure 6:
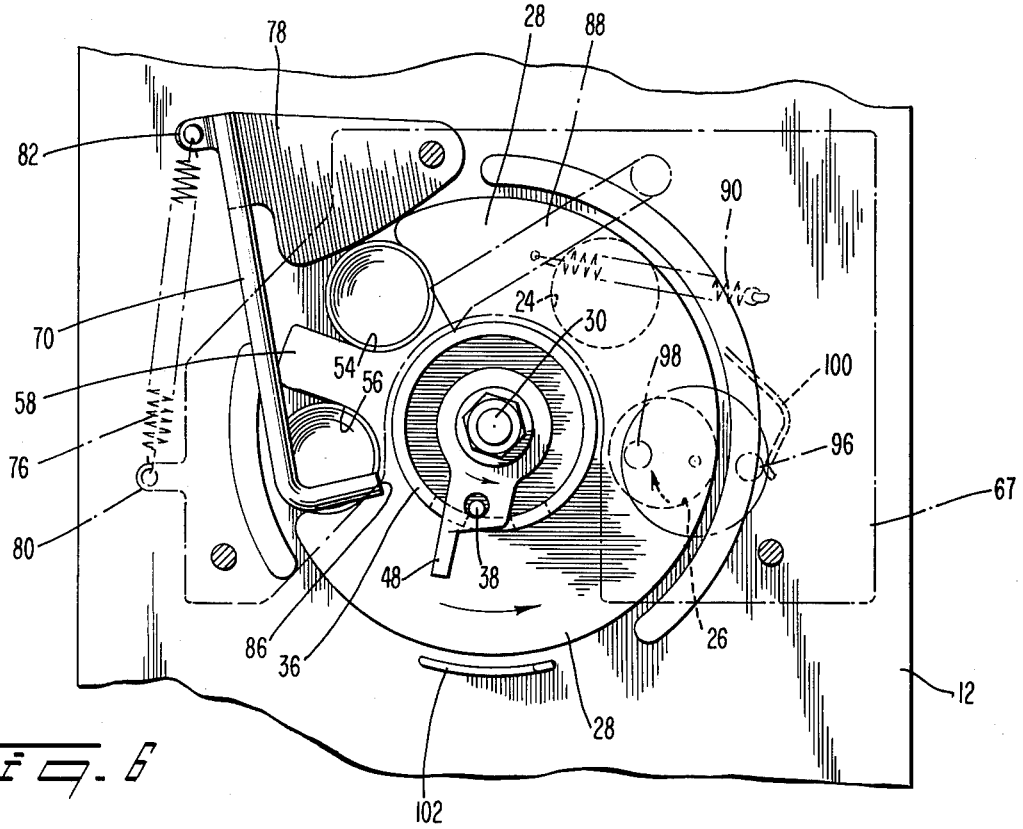
FIG. 6 is a rear view showing the device with two coins deposited and the dog disengaged with respect to the ring member detents.
Figure 7:
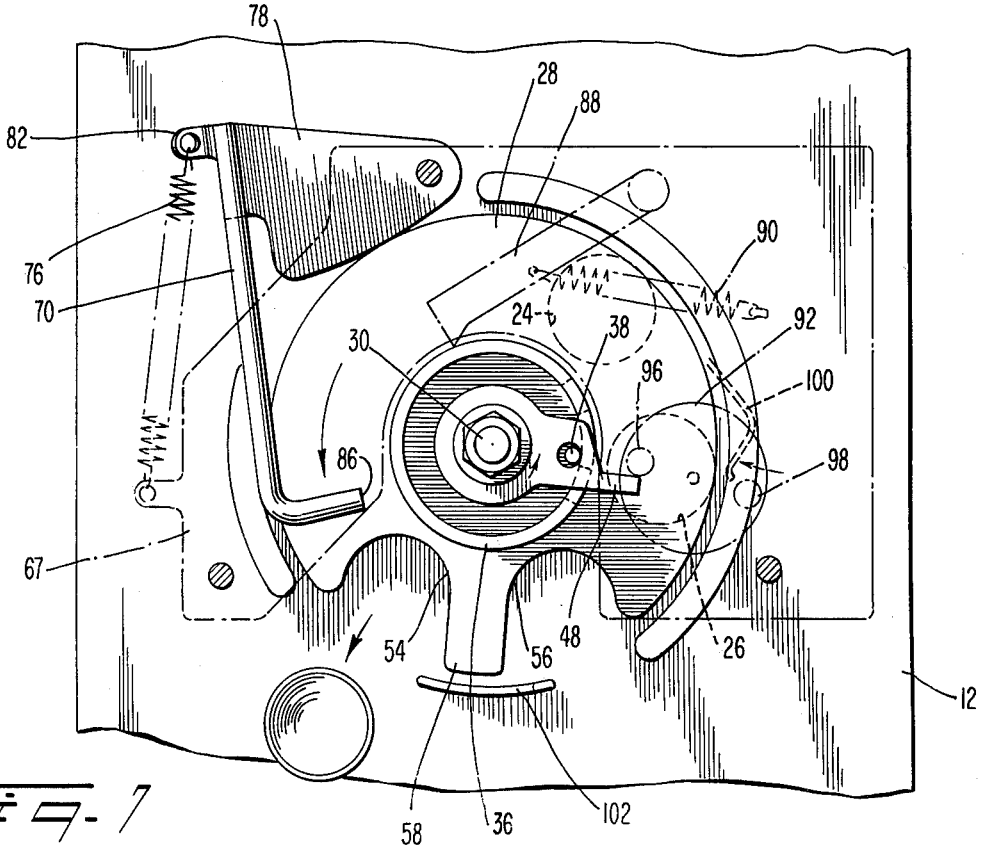
FIG. 7 is a rear view of the device showing the timer motor being actuated and second coin dropping from the disk toward a receptacle.

Assuming now that coins are deposited in both slots 54 and 56, as shown in FIG. 6, disk 28 may be rotated beyond the position shown since dog 70 is maintained in the second (non-engaged) position. During rotation of the disk beyond the position shown in FIG. 7, slot 56 becomes aligned between frame plate 67 and guide 102 permitting the first coin to drop in the slot into a collection receptacle (not shown). As rotation of desk 28 is continued, the second coin in slot 54 similarly drops, as shown in FIG. 7.

Actuator member 48 is angularly positioned on ring member 36 so as to contact pin 96 on rotary actuator 92 just as the second coin drops from slot 54. As disk 28 is rotated past the position shown in FIG. 7, rotary actuator 92 is rotated clockwise by contact between actuator member 48 and pin 96. Rotation of rotary actuator 92 by actuator rod 48 is sufficient to cause switch actuator 100 to slip pin 98, as shown by the dotted lines in FIG. 7. Timer motor 60 is then energized so that rotary actuator 92 makes a full revolution. The duration of time of the rotation is determined by the speed of the output shaft of timer motor 60. After one complete revolution, pin 98 again contacts switch actuator 100 urging the switch actuator back into the off position, shown in FIG. 6, and the timer motor is turned off.

In this disclosure there is shown and described only a specific embodiment of the invention, but, as aforementioned, it is to be understood that the invention is capable of use in various other combinations and environments and is capable of changes or modifications within the scope of the inventive concept as expressed herein.

What is claimed is:

1. A coin controlled apparatus, comprising:

a frame;

a central shaft passing through said frame;

a coin-carrying disk coupled to said central shaft and rotatable therewith, said disk containing at least one circumferentially located receiving slot;

detent means attached to said disk, said detent means including at least a first detent;

engagement means mounted to said frame member and pivotable between first and second positions, said engagement means being engageable with said detent in only the first position, said disk being locked against rotation during engagement;

clutch means for coupling said shaft to said disk, slippage therebetween being thereby provided when greater than a predetermined amount of torque is applied between said shaft and said disk; and cam means for guiding said engagement means into said first position for engagement with said detent in an absence of a coin located in said slot.

2. The apparatus of claim 1, wherein said detent means includes a ring member, and said engagement means includes a dog.

3. The apparatus of claim 1, wherein said disk contains first and second receiving slots, and said ring member contains first and second detents.

4. The apparatus of claim 3, wherein said cam means includes means for guiding said dog into said first position for engagement with (1) said first detent in an absence of a coin in said first receiving slot, and (2) said second detent in an absence of a coin in said second receiving slot.

5. The apparatus of claim 1 including spring biasing means for biasing said dog toward the first position.

6. The apparatus of claim 2, wherein said cam means includes a cam member rotatably mounted to said frame member adjacent said disk for pivoting said dog between the first and second positions, said coin receiving slots being located along an outer rim of said disk for contact with said cam member.

7. The apparatus of claim 6, wherein said cam member is secured to an end of said dog.

8. The apparatus of claim 2, including pawl means engageable with said detents of said ring member for permitting rotation of said coin carrying disk is only one direction.

9. The apparatus of claim 2, including an actuator member for coupling together said central shaft and said ring member, wherein said clutch means comprises a contact member mounted to said shaft and resiliently biased aganst said actuator member, frictional resistance being established between said contact member and said actuator member for rotating said disk via said central shaft.

10. The apparatus of claim 2, including electrical switch means for controlling the energization of a load device, and actuator means for operating said switch means.

11. The apparatus of claim 10, wherein said load device includes a timer motor.

12. The apparatus of claim 10, wherein said actuator means includes a rotary actuator attached to an output shaft of said timer motor, said switch means being operated by said rotary actuator when said rotary actuator is at a predetermined angle of rotation.

13. The apparatus of claim 12, wherein said actuator means further includes an actuator member connected between said central shaft and said ring member and extending to said rotary actuator, said actuator member contacting said rotary actuator for rotation thereof when said actuator member and rotary actuator are in a predetermined relative position.

14. The apparatus of claim 13, wherein said rotary actuator contains first and second diametrically opposed pins for contacting said actuator member and said switch means.

15. The apparatus of claim 14, wherein said pin members are located respectively on opposite faces of said rotary member.

16. The apparatus of claim 1, including a cover plate supported by said frame member, an end of said cover plate containing a recess for mounting said plate to a panel.

17. The apparatus of claim 16, wherein said cover plate further includes latch means for securing said plate to said panel.

18. The apparatus of claim 11, including connector means connected to said timer motor and said switch means for quick disconnect with respect to external circuitry.

* * * * *